US005398433A

United States Patent [19]

Dretzka

[11] Patent Number: 5,398,433

[45] Date of Patent: Mar. 21, 1995

[54] BUCKET DUMP BLOCK

[75] Inventor: Andrew P. Dretzka, Cudahy, Wis.

[73] Assignee: Harnischfeger Corporation, Brookfield, Wis.

[21] Appl. No.: 14,502

[22] Filed: Feb. 8, 1993

[51] Int. Cl.[6] ..... E02F 3/58

[52] U.S. Cl. ..... 37/399; 37/397; 254/416; 254/390; 212/100

[58] Field of Search ..... 37/397, 399, 396, 398, 37/395, 394; 212/201, 240, 252, 253, 262, 83, 100, 102; 384/417; 474/198, 199, 903, 166, 95; 254/416, 390

[56] References Cited

U.S. PATENT DOCUMENTS

| | | | |
|---|---|---|---|
| 1,999,682 | 4/1935 | Bakker | 37/398 |
| 2,904,906 | 9/1959 | Smith | 37/399 |
| 3,608,865 | 9/1971 | Kirk | 37/397 X |
| 3,954,017 | 5/1976 | Musgrove | 474/199 |
| 3,959,899 | 6/1976 | Rangaswamy | 37/397 |
| 4,143,856 | 3/1979 | Morrow, Sr. | 37/396 X |
| 4,640,496 | 2/1987 | Van Hoomissen et al. | 254/416 |
| 4,791,738 | 12/1988 | Briscoe . | |
| 5,154,401 | 10/1992 | Schramm et al. | 254/390 |

OTHER PUBLICATIONS

25 Pages from Page Engineering on Williams Product Catalogs.

*Primary Examiner*—Randolph A. Reese
*Assistant Examiner*—Spencer Warnick
*Attorney, Agent, or Firm*—Jansson & Shupe, Ltd.

[57] ABSTRACT

A bucket dump block, used on dragline buckets, has side frames and a rotatable rope-guiding sheave. In the improvement, each side frame has a separate ring-like support section extending toward the other side frame and abutting the support section of such other side frame. The sheave is supported by and rotates about such support sections. The sheave rides on an annular anti-friction member retained on a sleeve into which the support sections are press-fitted. The dump block (which is devoid of provisions for lubrication) has a minimum number of parts and is easy to manufacture and repair.

9 Claims, 5 Drawing Sheets

BUCKET DUMP BLOCK

FIELD OF THE INVENTION

This invention is related generally to mining of minerals and, more particularly, to dragline machines and buckets used for such mining.

BACKGROUND OF THE INVENTION

Digging machines known as draglines are widely used to remove earth "overburden" and thereby expose and mine a mineral, e.g., coal, which is beneath but near the earth's surface. Almost invariably, draglines are used at sites remote from any well-equipped service facility or storehouse of repair parts.

Smaller draglines are crawler mounted much like a military tank and capable of movement in the same way albiet at much slower speeds. However, as draglines increased in size, crawler mounting was found to be impractical and in the early 1900's, the "walking" dragline was developed. The walking dragline is so named because it takes short "steps" and uses a walk leg mechanism (which resembles a human leg) to do so. A difference is that in a walking dragline, both legs step simultaneously.

A dragline is equipped with an angularly-extending boom from which is suspended a "bucket" having an open mouth and digging teeth, both toward the main portion of the machine. Overburden is removed by placing the bucket on the ground at a point distant from the machine and pulling it toward the machine, filling the bucket in the process. Once filled, the machine pivots about a central axis and the bucket emptied, at a spoil pile somewhat away from the area being excavated.

In other types of digging machines, e.g., a power shovel or backhoe, the bucket is attached to a rigid arm and can be forced through the material being removed. A dragline bucket (and the manner of bucket attachment) differ from such machines in that the dragline bucket is attached to the machine solely by flexible cables, chains and the like. Therefore, the weight of the bucket and the design and arrangement of its teeth (along with other factors) are important in configuring a dragline bucket which digs efficiently. An example of a dragline bucket is shown in U.S. Pat. No. 4,791,738 (Briscoe) and in trade literature filed with this specification.

As the dragline bucket is pulled toward the machine, it is generally horizontal for substantially complete filling. To empty the bucket, the operator actuates controls which tips such bucket to a near-vertical position with the teeth pointing downward. One component of the cable, chain and linkage arrangement connecting the bucket and the machine and used to control bucket "attitude" or orientation is called a dump block.

A dump block is a pulley-like device which, unlike a block-and-tackle, provides no mechanical advantage but which is used to change the direction of the force exerted by a flexible cable. Examples of dump blocks are depicted in the aforementioned Briscoe patent and literature.

Known dump blocks are relatively heavy, complex and expensive to manufacture. For example, side plates and sheaves are often made from castings and compared to other ways to make such parts, metal casting is a relatively expensive process. And such castings need to be machined before they can be assembled. Such side plates often require that a pocket be machined in the plate to receive and hold one end of a pin held in place by a through-bolt.

Similarly, at least the hub of the sheave casting needs to be machined to fit over a sleeve-type bearing or to receive the cup of a roller bearing. The pin itself may also require machining to fit properly with seals and bushings.

While such dump blocks have been generally satisfactory for their intended purpose, they tend to be characterized by certain disadvantages. In one type of common dump block, there is well in excess of 30 separate parts. Since dump blocks are frequently serviced "on site," this multiplicity of parts (some of which are rather small) almost assures that a part will be dropped in the dirt or lost during field service. And, of course, such multiplicity of parts complicates the matter of keeping a proper inventory of repair parts.

Yet another disadvantage is that the bearings (of whatever type) are subject to relatively rapid wear due to contaminants—dirt, rock dust and the like—in the operating environment. In an effort to prolong the life of such bearings, the dump block is configured so that such bearings can be greased periodically. But even at that, disassembly and repair tends to be relatively frequently required.

An improved dump block which is made of a minimum number of easily-made and relatively-large parts, which maximizes parts "commonality," which does not need lubrication, which takes advantage of relatively new materials, which is relatively light in weight and which is easy to assemble and disassemble would be an important advance in the art.

OBJECTS OF THE INVENTION

It is an object of this invention to provide an improved dump block overcoming some of the problems and shortcomings of dump blocks of the prior art.

Another object of this invention is to provide an improved dump block in which the number of parts is substantially less than the number of parts in known dump blocks.

Yet another object of this invention is to provide an improved dump block including plural parts which are identical to one another.

Another object of this invention is to provide an improved dump block which is easy to assemble and disassemble.

Still another object of this invention is to provide an improved dump block incorporating parts made of relatively recently-available materials.

Another object of this invention is to provide an improved dump block which is relatively light in weight.

How these and other important objects are accomplished will be apparent from the following descriptions and from the drawing.

SUMMARY OF THE INVENTION

The invention is an improvement in a bucket dump block, a pulley-like device used in controlling the digging and dumping "attitude" of the bucket of a dragline. Common dump blocks have a pair of side frames and a rope-guiding sheave mounted for rotation between the frames.

In the improvement, each side frame includes a side plate and an integral, ring-like support section attached to that side plate and extending toward the other side frame. The sheave is supported by and rotates about the support sections. The inventive dump block can be configured in any of several ways and some of them are discussed below. In the highly preferred dump block, the support sections are of substantially equal length and each support section has an end surface abutting the end surface of the other support section.

The block also includes an annular, ring-like sleeve and the support sections and the sleeve are press-fitted together. Preferably, the sleeve circumscribes the support sections and such sections are press-fitted into the sleeve so that the side frames, the support sections and the sleeve are thereby retained in a fixed relationship to one another.

In another aspect of the invention, the dump block includes an annular, ring-like anti-friction member mounted on and circumscribing the sleeve. Such member provides a wear surface contacting the sheave and the sheave rotates with respect to such anti-friction member. In other words, the support sections, the sleeve and the anti-friction member (which are preferably concentric) are all stationary with respect to the side plates and the sheave rotates with respect to all of those parts.

In yet another aspect of the invention, each side frame includes an interior face and the sheave has a pair of exterior surfaces. Preferably, such faces and surfaces are substantially planar. An annular, disc-like side bushing is interposed between each exterior surface and each interior face and provides a bearing-like wear structure between each interior face of a side frame and the adjacent exterior surface of the sheave.

And the sheave itself includes some novel features. For example, the sheave is annular and has a pair of spaced, substantially planar, substantially parallel exterior surfaces. A circumferential cable groove is formed between the exterior surfaces and the sheave is made of a plastic material.

In another arrangement of the inventive dump block, the improvement comprises a single, tube-like support section extending between the side plates and supporting the sheave for rotation. While this arrangement does not provide the identity of parts (discussed below) of by the highly preferred embodiments such arrangement is entirely operable, highly useful and incorporates many of the cost-saving features of such embodiment. In other details, such arrangement is similar to the highly preferred embodiment in its inclusion of an anti-friction member interposed between the support section and the sheave and the inclusion of a side bushing interposed between the sheave and each interior face.

Further details of the invention are set forth in the detailed description and the drawing.

DETAILED DESCRIPTIONS OF THE PREFERRED EMBODIMENTS

Before describing the inventive dump block 10 and to give additional perspective to the following discussion, some features of a walking dragline are discussed. The exemplary dragline is one of the world's largest machines and is made by Harnischfeger Industries of Milwaukee, Wis.

Figure 1:
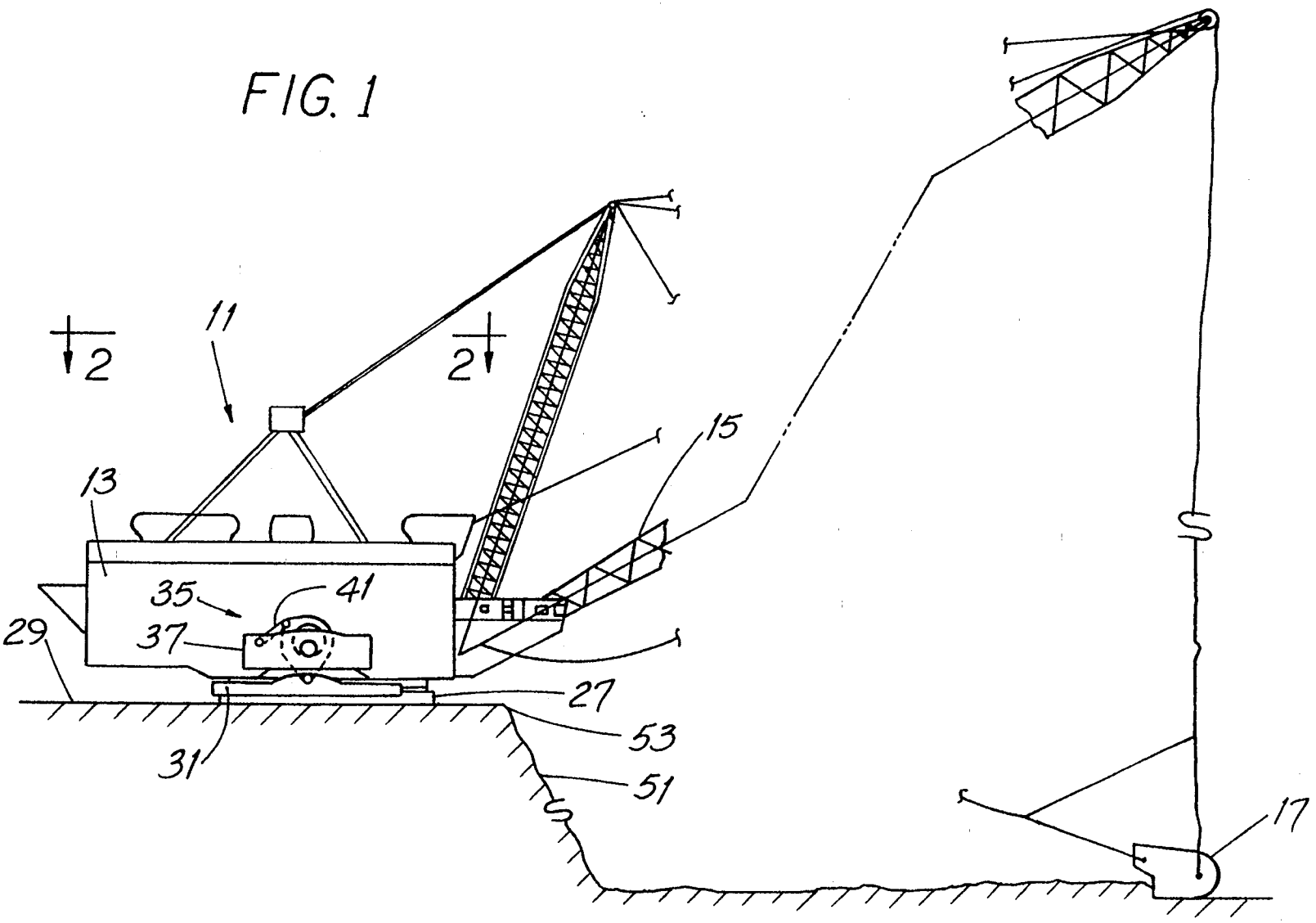
FIG. 1 is a representative side elevation view of a dragline of the type on which the inventive dump block is used.
Figure 2:
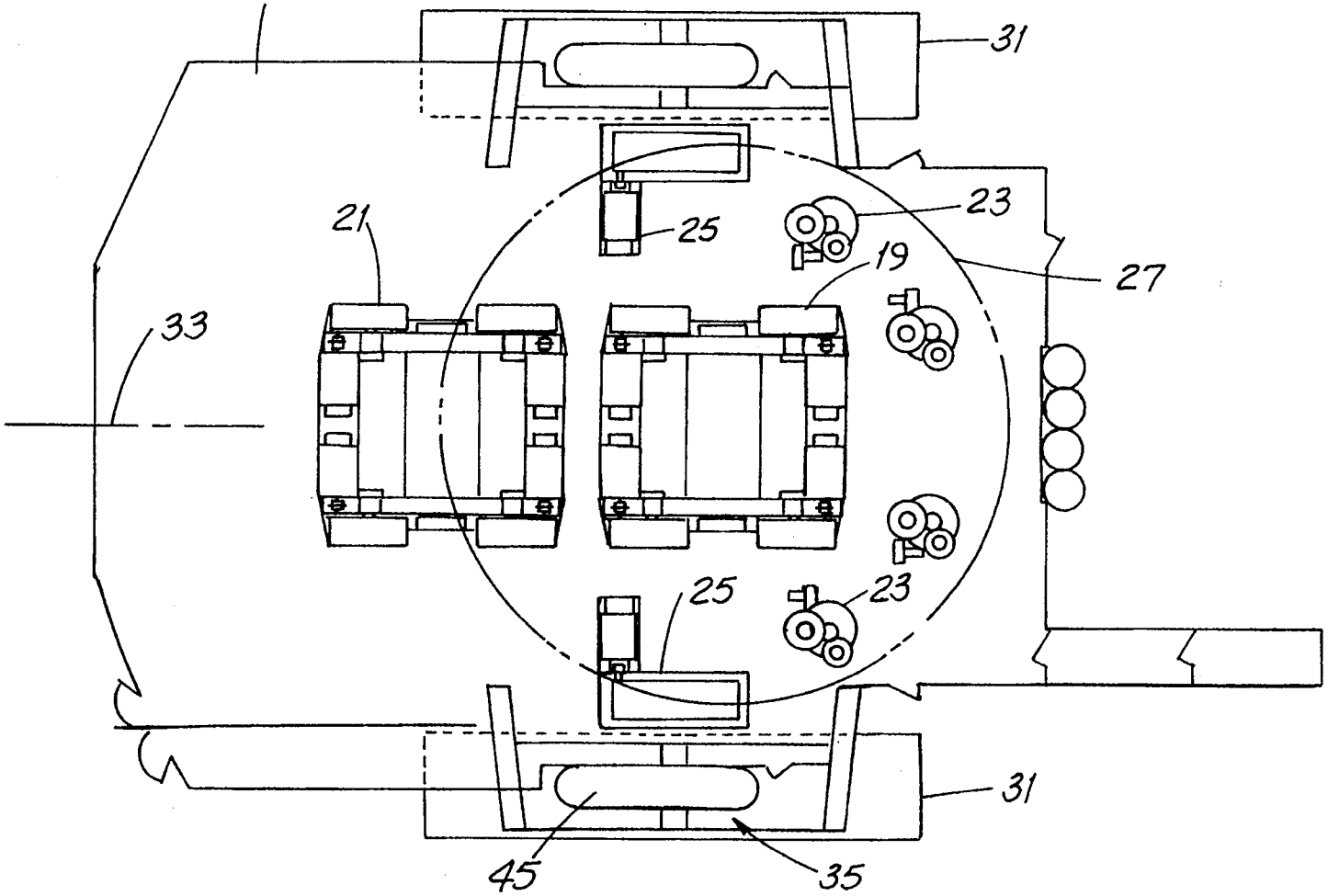
FIG. 2 is a top plan view, in phantom, of the main housing portion of the dragline of FIG. 1, taken along the viewing plane 2—2 thereof and with parts broken away.
Figure 3:
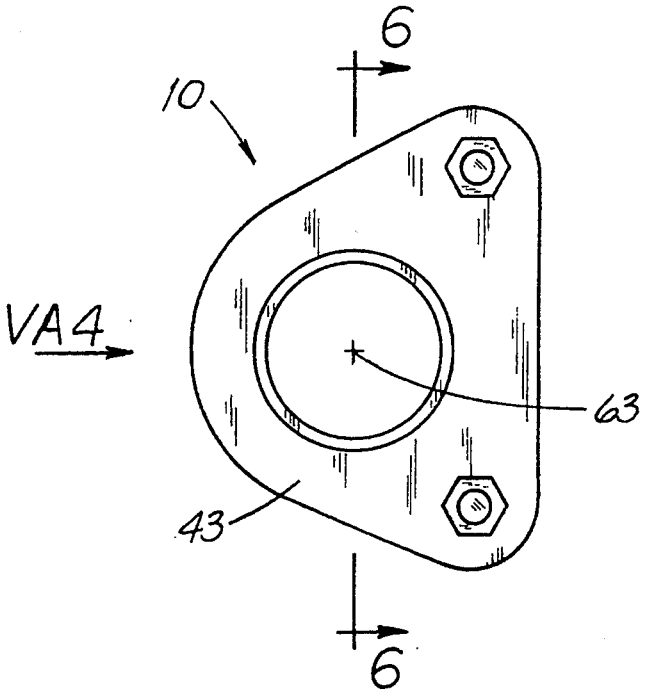
FIG. 3 is a side elevation view of the inventive dump block.
Figure 4:
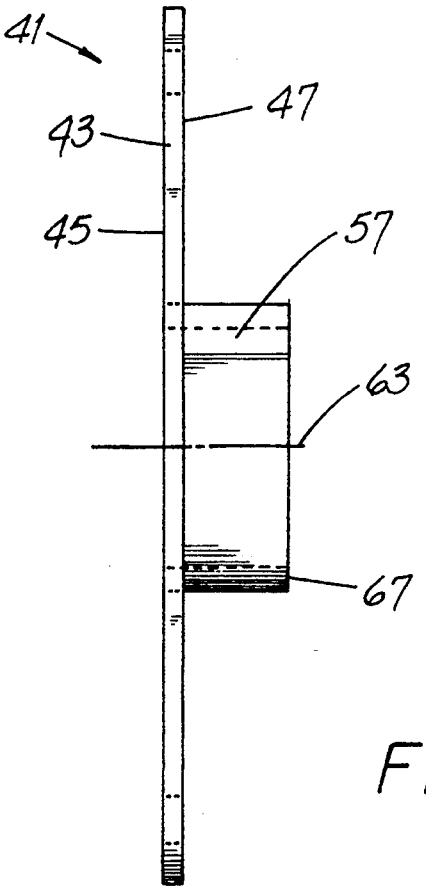
FIG. 4 is an elevation view of a side frame of the dump block taken generally from the perspective of viewing axis VA4 of FIG. 3.
Figure 5:
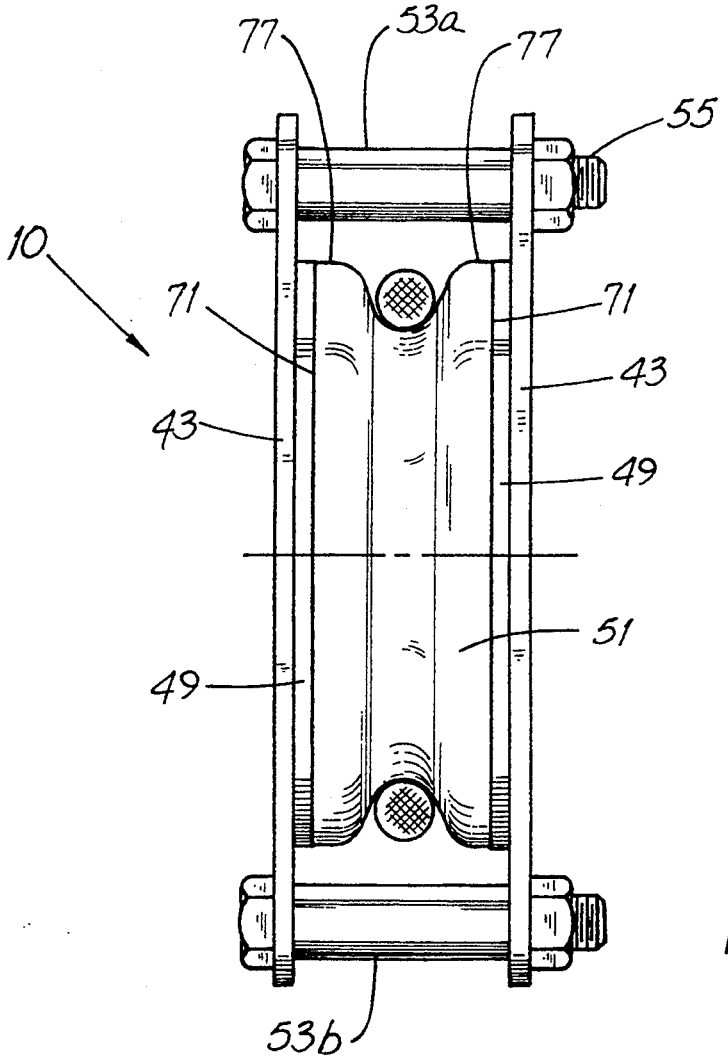
FIG. 5 is an elevation view of the dump block taken generally from the perspective of viewing axis VA4 of FIG. 3.
Figure 7:
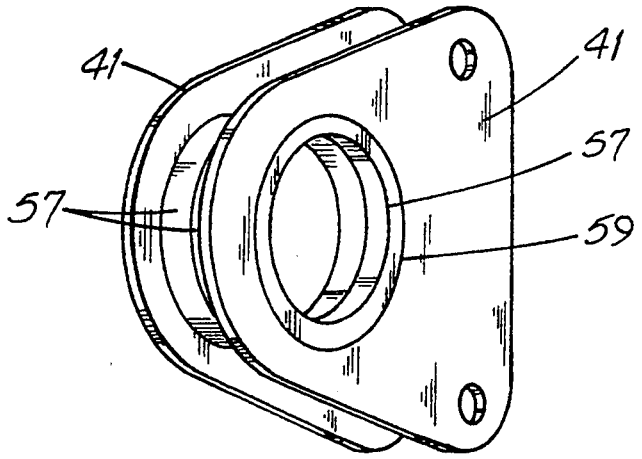
FIG. 7 is an isometric view of two side frames of the dump block shown in abutting relationship.

Referring first to FIGS. 1 and 2, the walking dragline 11 includes a main housing portion having a boom 15 extending therefrom to support and manipulate a digging bucket 17. Within the housing portion 13 are mounted the bucket hoist, bucket drag and swing systems 19, 21 and 23, respectively. The drive 25 for the "walking" system is also mounted therein. When digging, the dragline 11 sits on and pivots about a generally circular "tub" or platform 27 which rests on the earth's surface 29.

The dragline 11 also includes a pair of pads or "shoes" 31 which, when moved in unison, lift the platform 27 and move the dragline 11 rearward away from the bucket 17. Movement in the exemplary dragline 11 is in "steps" of about seven feet in length and along the long axis 33 of the main housing portion 13.

The main housing portion 13 is about 105 feet long, about 80 feet wide, about 40 feet high and weighs about nine million pounds. The boom 15 extends about 300 feet and the capacity of the digging bucket 17 is about 80 cubic yards. Of course, it is to appreciated that the inventive dump block 10 is well adapted for use with draglines and digging buckets of varying size and irrespective of the particular manufacturer.

Referring next to FIGS. 3–7, the dump block 10 (which is devoid of any provision for greasing) includes a pair of side frames 41, each having a substantially flat, generally triangular side plate 43. Each side plate 43 has an outer or exterior face 45 and an interior face 47. Such faces 45, 47 are generally parallel to one another and the interior face 47 is in contact with a side bushing 49 and is adjacent to the sheave 51. The side plates 43 are retained in a spaced relationship to one another by a pair of spacers 53, each held in place by a through-bolt 55. Such spacers 53 not only retain plate-to-plate spacing but also provide connection points for the hoist rope (spacer 53*a*) and for the hoist chains (spacer 53*b*). The side plates 43 may be made by, for example, flame cutting them from steel plate.

Figure 6:
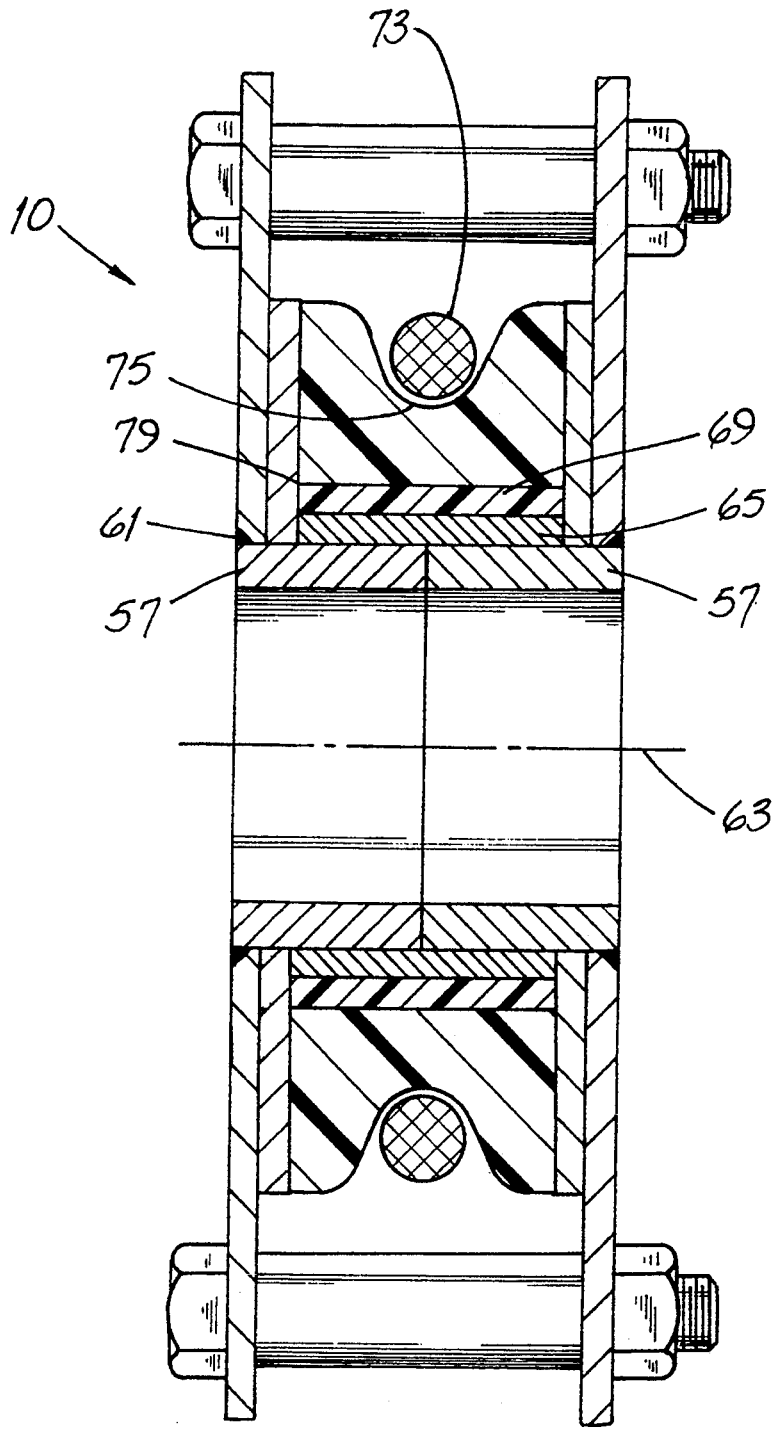
FIG. 6 is a cross section view of the dump block taken along the viewing plane 6—6 of FIG. 3. Surfaces of certain parts are shown in dashed outline.

Each side frame 41 also includes a hollow, tube-like support section 57. Each such section 57 has an outside diameter substantially equal to that of the other section 57 and to the diameter of an aperture 59 formed in each side plate 43. As shown in FIG. 6, each support section 57 is attached to its corresponding side plate 43, preferably by weld 61. Each support section 57 may be made by, for example, sawing it from commonly-available steel tubing.

In a highly preferred embodiment, the support sections 57 are of substantially equal length (as measured along the axis of sheave rotation 63) and extend from the interior face 47 of the respective side plate 43 by the same distance. When so configured, the side frames 41 are substantially identical to one another, thus effecting certain manufacturing economies and simplifying parts inventory.

Referring further to FIG. 6, the dump block 10 also includes a hollow, tube-like sleeve 65 having an inside diameter about the same as the outside diameter of the support sections 57. Such diameters are preferably selected so that the support sections 57 "telescope" into the sleeve 65 with pressed fit. In that way, the sleeve 65, the side plates 43 and the support sections 57 are maintained in a fixed relationship to one another. Preferably, the end surfaces 67 of the support sections 57 abut one another when the sections 57 are press-fitted and fully "seated" in the sleeve 65. As described in more detail below, the sleeve 65 not only retains the enumerated parts in a fixed relationship, it also provides support for an anti-friction member 69 about which the sheave 51 rotates.

The anti-friction member 69 is hollow and tube-like and has an inside diameter substantially the same as the outside diameter of the sleeve 65. Such member 69 is made of bronze, hard-coated plastic or other anti-friction material forming a wear surface between the member 69 and the sheave 51. And such member 69 is bonded or otherwise affixed to the sleeve 65 so that the member 69 does not rotate with sheave rotation.

The sheave 51 (which resembles an annular ring) has a pair of spaced, generally flat exterior surfaces 71, one each in a plane generally normal to the axis of rotation 63. To guide the cable 73 passing over the sheave 51, there is a circumferential groove 75 centered between the surfaces 71 and bounded by lands 77. A sheave aperture 79 has a diameter substantially equal to the outside diameter of the anti-friction member 69. Such diameters are preferably selected to provide very slight clearance so that the sheave 51 can freely rotate on the member 69 but so that there is virtually no radial "play" between the sheave 51 and member 69.

A side bushing 49 is interposed between each interior face 47 of a side plate 43 and the closely-adjacent exterior surface 71 of the sheave 51. Such side bushings 49, which are annular, of equal thickness, generally flat and disc-like, may be made of bronze, Teflon®-coated plastic or the like to provide a good bearing surface between the sheave 51 and the side plate 43. And in a highly preferred arrangement, such side bushings 49 are substantially identical to one another, thus effecting further manufacturing economies and further simplifying parts inventory.

It is to be appreciated that the widths of the sheave 51, the anti-friction member 69 and the sleeve 65 (as measured parallel to the axis of rotation 63) are substantially equal and less than the distance between the interior faces 47 of the side plates 43 by about the thicknesses of both side bushings 49. Such thicknesses should be selected so that the sheave 51 turns freely between the bushings 49 but so that there is virtually no axial "play" between the sheave 51 and the bushings 49. In the highly preferred embodiment, the new dump block 10 has about 15 prts including nuts and bolts, well less than the number of parts in known dump blocks.

While the principles of the inventive dump block 10 have been described in connection with specific embodiments, it should be understood clearly that these descriptions are made only by way of example and are not intended to limit the scope of the invention. Any of several variations are possible without departing from the invention.

For example, the support sections 57 need not be of equal length. While support sections 57 of disparate length would not take advantage of the available manufacturing economies and opportunities for inventory reduction, the resulting dump block 10 would be fully operable.

As another example, the support sections 10 may be formed as a single tube-like piece, one end of which is welded to a side plate 43 and the other end of which merely extends into the aperture 59 of the other side plate 43 but is not attached to such other side plate 43.

I claim:

1. In a bucket dump block having a pair of side frames and a rope-guiding sheave mounted for rotation between the frames, the improvement wherein:

each side frame includes a support section attached to the side frame and extending toward the other side frame;

the sheave is supported by and rotates around the outside of the support sections, and wherein:

the sheave has annular side surfaces;

the dump block includes a disc-like side bushing interposed between the sheave and each of the side frames and stationary with respect to such side frames; and each side bushing has a diameter about the same as the diameter of the sheave, whereby each side bushing extends substantially across a side surface of a respective side frame and prevents the sheave from wearing against a side frame.

2. The dump block of claim 1 wherein each support section has an end surface abutting the end surface of the other support section.

3. The dump block of claim 1 further including a sleeve and wherein the support sections and the sleeve are press-fitted together, thereby retaining the side frames, the support sections and the sleeve in a fixed relationship to one another.

4. The dump block of claim 3 wherein:

the support sections are of substantially equal length; and, each support section has an end surface abutting the end surface of the other support section.

5. The dump block of claim 3 wherein:

the support sections are pressed into the sleeve;

the block includes an anti-friction member mounted on the sleeve and providing a wear surface contacting the sheave; and, the sheave rotates with respect to the anti-friction member.

6. In a dump block having a pair of side frames, each with an interior face, and also having a rope-guiding sheave having a pair of exterior surfaces and being mounted for rotation between the frames, the improvement comprising:

a support section stationary with respect to the side frames and supporting the sheave for rotation;

an anti-friction member interposed between the support section and the sheave and providing a wear surface contacting the sheave, the anti-friction member being stationary with respect to the side frames; and a sleeve interposed between the anti-friction member and the support section and being stationary with respect to the side frames.

7. In a bucket dump block having a pair of side frames and a rope-guiding sheave mounted for rotation between the frames, the improvement wherein:

the block includes a sleeve extending toward the side frames;

each side frame includes an integral support section extending toward the other side frame;

the support sections and the sleeve are press-fitted together;

each support section has an end surface abutting the end surface of the other support section, and the sheave is supported by and rotates about the support sections.

8. The dump block of claim 7 wherein:

the support sections are of substantially equal length.

9. The dump block of claim 7 wherein:

the support sections are pressed into the sleeve;

the block includes an anti-friction member mounted on the sleeve and providing a wear surface contacting the sheave; and, the sheave rotates with respect to the anti-friction member.

* * * * *